US005115957A

United States Patent [19]

Smith et al.

[11] Patent Number: 5,115,957

[45] Date of Patent: May 26, 1992

[54] APPARATUS FOR REINFORCING FIBROUS DUCT

[75] Inventors: Harvell M. Smith, Evergreen, Colo.; Edward J. Marx, Baltimore, Md.; Robert R. Coleman, Westminster, Colo.

[73] Assignee: Manville Corporation, Denver, Colo.

[21] Appl. No.: 557,298

[22] Filed: Jul. 23, 1990

[51] Int. Cl.[5] ..... A43D 71/00; B23P 19/04

[52] U.S. Cl. ..... 227/67; 29/33 F; 29/419.1; 29/432.2

[58] Field of Search ..... 29/432, 432.1, 432.2, 29/419.1, 818, 33 F, 33 T, 509, 67, 68, 73, 77, 79; 138/147, 148, 149, 172, 173, 174

[56] References Cited

U.S. PATENT DOCUMENTS

| | | | |
|---|---|---|---|
| 2,126,161 | 8/1938 | Woodward | 29/432.2 |
| 2,171,388 | 8/1939 | Berger | 29/432.1 |
| 3,325,879 | 6/1967 | Morkoski | 29/432.2 X |
| 3,867,968 | 2/1975 | Ritter et al. | 29/509 X |
| 4,027,370 | 6/1977 | Bachar | 29/432.2 X |
| 4,315,361 | 2/1982 | Brooks | 29/432.1 |
| 4,706,362 | 11/1987 | Strausburg | 29/432 |

*Primary Examiner*—Joseph M. Gorski
*Assistant Examiner*—Peter Dungba Vo
*Attorney, Agent, or Firm*—John D. Lister; Cornelius P. Quinn

[57] ABSTRACT

The reinforcing wires in a fibrous duct are inserted by simultaneously piercing opposite sides of the duct with elongated piercing means mounted on a reciprocally movable frame. The piercing means may be the reinforcing wires themselves or may be separate structure, such as tubes, which can function as guides for the insertion of the wire before they are withdrawn.

5 Claims, 5 Drawing Sheets

FIG. 2C
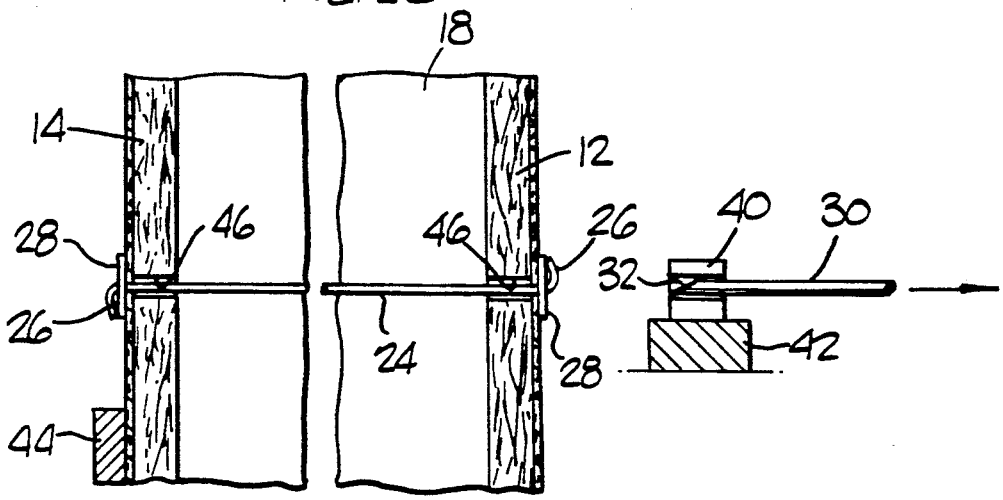
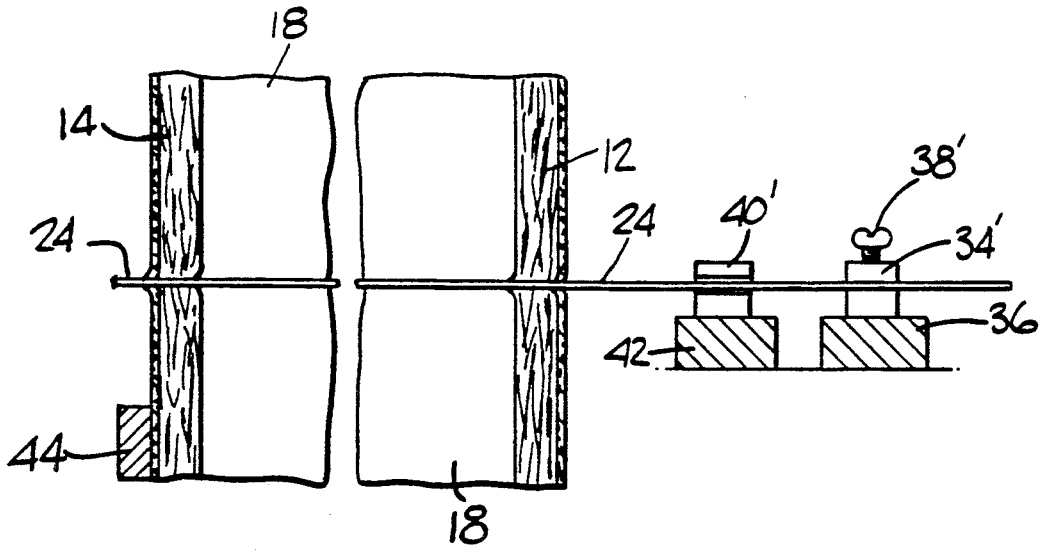
FIG 7

APPARATUS FOR REINFORCING FIBROUS DUCT

FIELD OF THE INVENTION

This invention relates to fibrous ducts of the type used for carrying conditioned air. More particularly, it relates to a method and apparatus for inserting wire or other tie rod reinforcing material through the walls of such ducts.

BACKGROUND OF THE INVENTION

Ducts fabricated from fiber glass boards have long been used in the transportation of heated or cooled air. Typically, treated air is supplied to a duct through an intake vent and is moved through the duct to various outlets by means of a fan. This produces either a positive or negative pressure condition inside the duct which, if sufficiently high, tends to bow the duct walls and eventually weaken the joints between the walls. It is often necessary to reinforce the ducts against these forces.

Ducts are commonly reinforced by threading a wire through opposite walls of the duct and securing the ends of the wire to prevent them from slipping through the wall into the interior of the duct. This provides the needed tensile strength to hold the duct walls in place, but at the same time increases the cost of the duct due to the added time of fabrication. This added time can be three to four times as much as other fabrication steps. This is because the layout of the reinforcing wire and the actual threading and installation of the wire have been done by hand.

It would be desirable to be able to automatically install reinforcing wire so that this phase of the fabrication process could be done as efficiently as the semi-automatic cutting and grooving operation. Until now, there has not been a satisfactory machine for accomplishing this.

SUMMARY OF THE INVENTION

This invention accomplishes the foregoing object by providing a plurality of elongated piercing means mounted for movement toward and away from a duct positioned against a back-up support. The piercing means are arranged so that at the point of contact with the duct wall they correspond to the intended locations of the plurality of lengths of tensile reinforcement. In a preferred embodiment, the piercing means are tubes or appropriately shaped shafts adapted to penetrate the fibrous walls of the duct and, before being withdrawn, to act as a guide for the insertion of the reinforcing wire. In another embodiment the reinforcing material itself may act as the piercing means so that it will automatically be in place upon completion of the piercing operation. The apparatus for carrying out these steps comprises relatively movable and adjustable frames which allow the equipment to be used on ducts of various sizes. The apparatus is compactly arranged so as not to take up much floor space.

Other features and aspects of the invention, as well as its various benefits, will be made clear in the more detailed description of the invention which follows.

BRIEF DESCRIPTION OF THE DRAWINGS

FIG. 2C is a view of the duct of FIG. 2B, showing the duct after the piercing device has been removed and the wire ends have been secured in place;

FIG. 7 is a partial sectional view similar to that of FIG. 2A, but showing the use of wire reinforcement as the piercing member.

DESCRIPTION OF THE INVENTION

Figure 1:
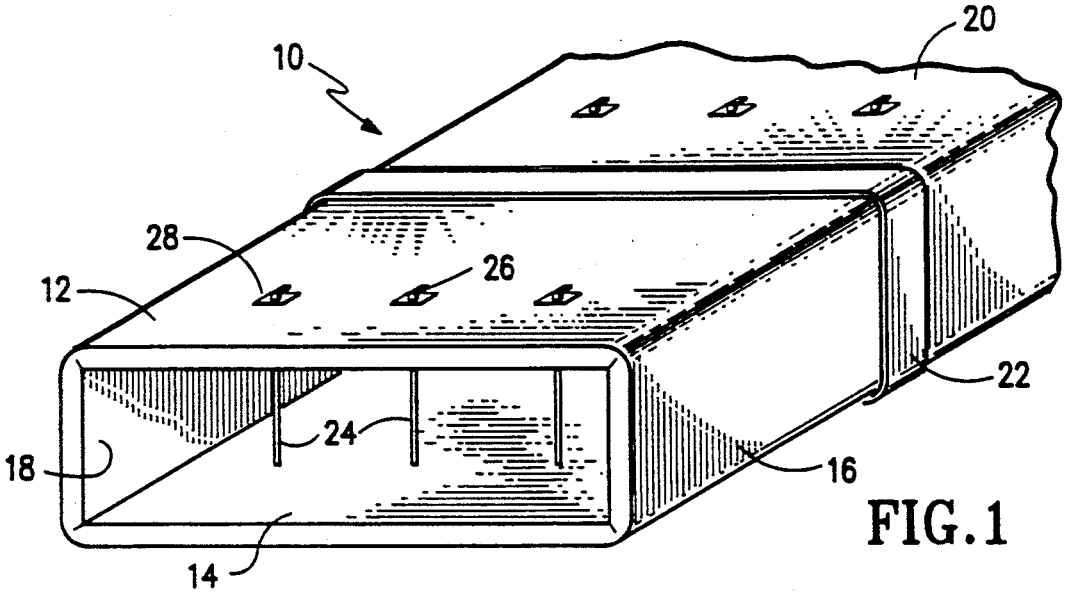
FIG. 1 is a partial pictorial view of a length of reinforced fibrous duct.

Referring to FIG. 1, a length of fibrous duct of typical design is indicated generally at 10. The duct comprises opposing walls 12 and 14, which determine the width of the duct, and opposing walls 16 and 18, which determine the depth or height of the duct. The installed duct network in a building is comprised of a number of sections of duct connected end to end in the field by methods well known in the industry. Each section of duct 10 is generally quite long, although typically measuring 4 feet in length, it may be as long as 10 feet, which increases the difficulty of providing reinforcement thereto by hand. This duct is formed from single or multiple fibrous boards which have been folded along V-grooves to form a duct of rectangular cross section. One of the corners of a duct of this type will be formed by the contacting free edges of the fibrous board, and this corner is normally taped, as indicated at 20. Tape 22 can also be used to transversely encircle the duct to connect duct sections together. The fibrous board commonly is faced with a foil layer which becomes the outer surface of the duct.

The fibrous board used in forming the duct length is normally a board of bonded fiber glass having a nominal thickness of about 1 inch and a density in the approximate range of 3–6 pcf. Such a board is ideally suited in most respects for use in a duct. It is lightweight and easy to handle, it acts as a heat and sound insulator, and it is relatively inexpensive. It does not, however, always have sufficient strength and rigidity to withstand the outwardly directed forces of the positive or negative air pressure to which the duct will be subjected. This is commonly provided by the reinforcing tie rods or wires 24 extending between the walls 12 and 14. Normally they are applied by hand, with the workmen being required to puncture the walls of the duct and thread each wire through, after which the ends 26 of the wires are secured by being twisted or bent against metal washers 28 which lie flat against the duct walls. For an eight-foot length of duct there would typically be twenty-four such tie rods. It can be seen how an extensive tie rod arrangement such as this could easily take half an hour or more to install.

Figure 2A:
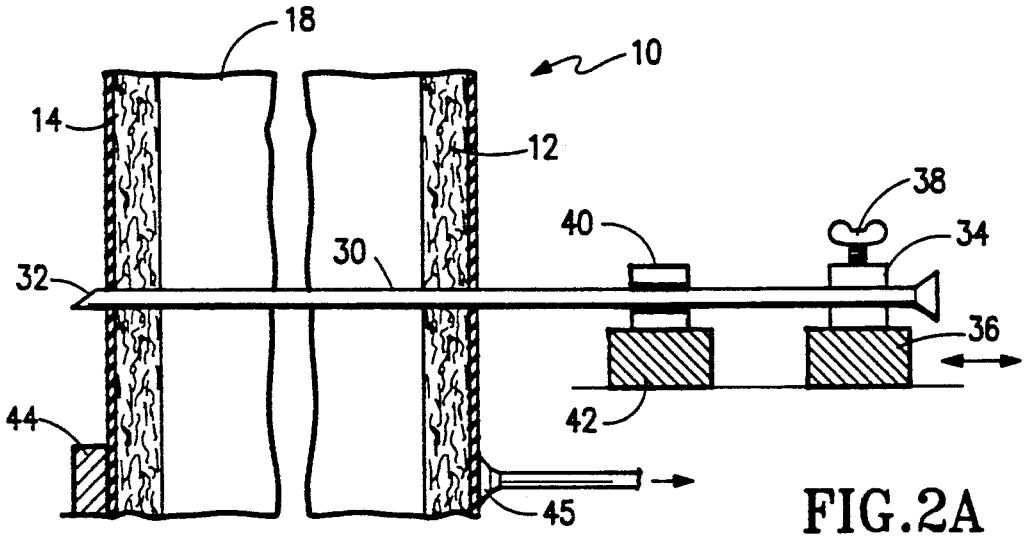
FIG. 2A is a partial sectional view of a duct the opposite walls of which have just been pierced by an apparatus of the present invention.

Referring to FIG. 2A, in a preferred embodiment of the invention a section of duct 10 is stood on end so that the walls 12 and 14 are upright, and a tube 30 is driven through both walls 12 and 14. The leading end of the tube 30 can be sharpened to a point, as indicated at 32, to facilitate the piercing of the fiber glass walls. The tube is received adjacent its trailing end in a bushing 34 which is attached to a movable frame member 36. The tube is held in place in the bushing by thumb screw 38, which allows the tubes to be removed or replaced as required by the design of the duct being fabricated. The tube 30 passes through a guide bushing 40 attached to a fixed frame member 42 located between the duct 10 and the movable frame member 36. This arrangement serves to support and guide the tube as it moves toward and away from the duct. A back-up support 44 holds the duct in place against the impact of the tube 30 as the tube contacts and pierces the walls 12 and 14. To prevent the upstream wall 12 of the duct from collapsing upon impact by the tube, suction cups 45 are provided at spaced locations on the wall 12 to provide a force in opposition to the force of the tube so as to neutralize the impact of the tube.

Figure 2B:
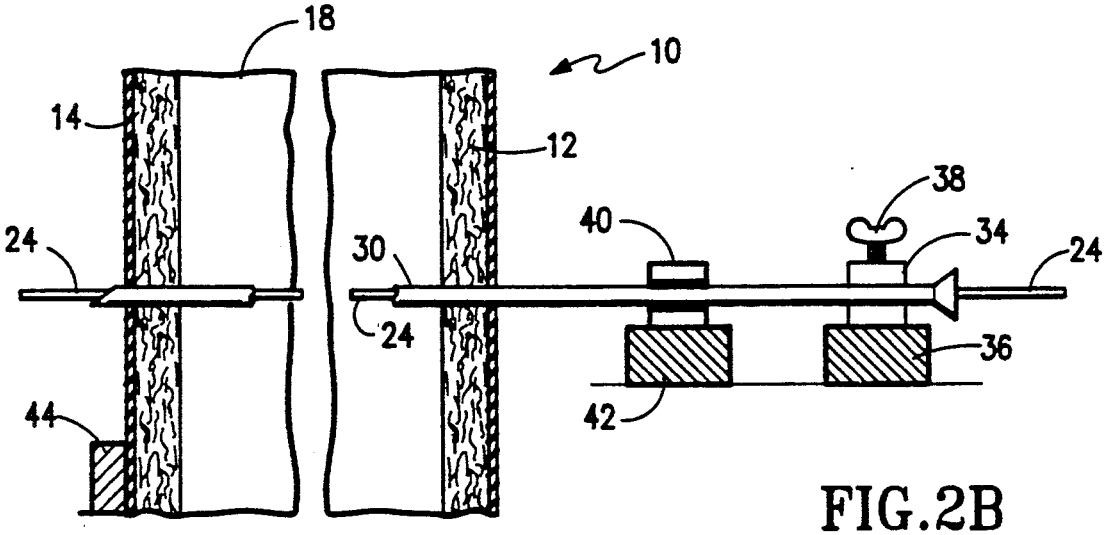
FIG. 2B is a partial sectional view of the duct of FIG. 2A, showing the duct after reinforcing wire has been inserted.

After the tube 30 has pierced both walls of the duct and while the tube is held in the position shown in FIG. 2A, a tie rod reinforcing member or wire 24 is inserted through the tube as shown in FIG. 2B. Although not shown, it should be understood that the wire can be fed directly from a coil through a wire straightener into the tube 30. The wire may be of the type conventionally used as a tie rod, and the tube should be of a size enabling it to pierce the duct walls and to receive the wire. For example, a 16 gauge wire used with a tube having an outside diameter of ¼ inch and an inside diameter of ⅛ inch has been found to function well. The wire is positioned so that it protrudes past the wall 14 a distance sufficient to allow a washer to be slipped over it and the end of the wire twisted or bent to hold it in place against the washer. The wire at the other side of the duct is cut off a similar distance from the duct wall 12 after the tube 30 has been withdrawn from the duct to allow a similar wire end arrangement to be provided.

After the tube has been withdrawn, the washers 28 applied and the ends of the wire bent into place, the installed reinforcing wire appears as in FIG. 2C. The apertures 46 in the duct walls 12 and 14, created by the insertion of the tube 30, are larger than the diameter of the wire 24. This does not have a negative effect on the strength or rigidity of the duct, however, because the washers 28 extend substantially beyond the apertures and are supported against the duct wall portions surrounding the apertures, thereby providing adequate support for the bent or twisted wire ends. Although only a single tube and wire arrangement has been illustrated in FIGS. 2A, 2B and 2C, it should be understood that a number of tubes are moved simultaneously to provide the openings for the wire reinforcements and subsequently to function as wire guides as the wire is fed through the duct.

Figure 3:
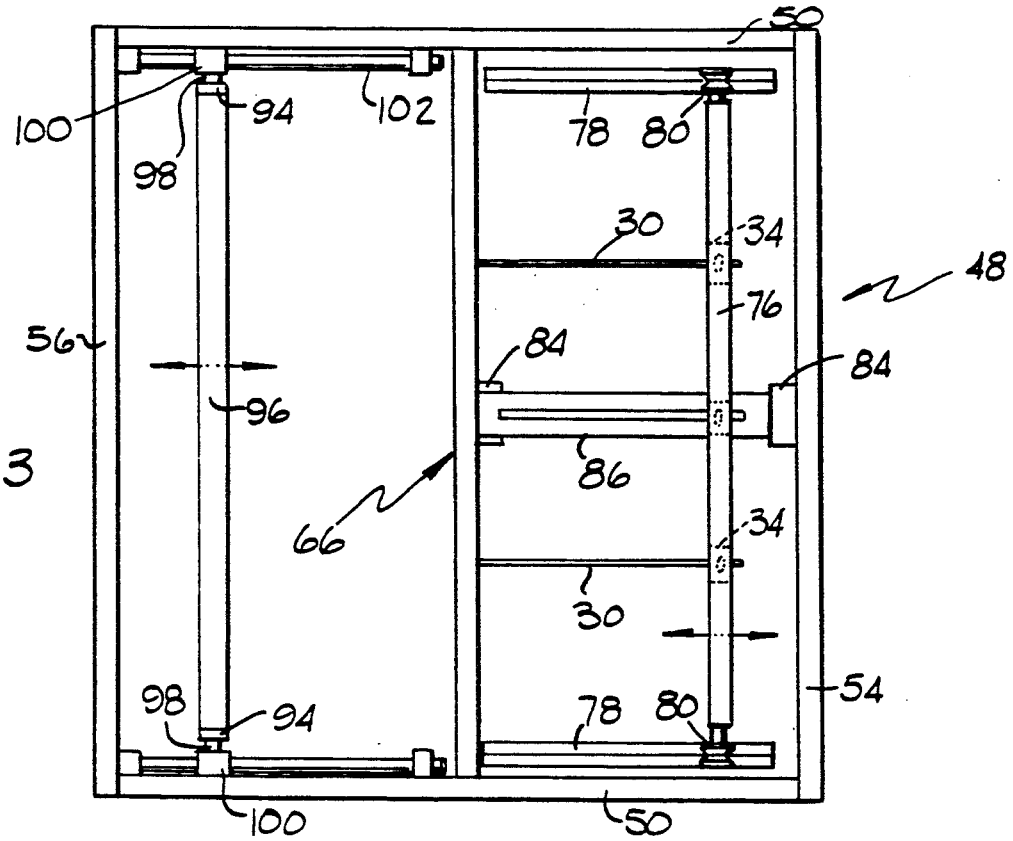
FIG. 3 is a top view of the apparatus of the present invention, showing the relationships of the various frames.
Figure 4:
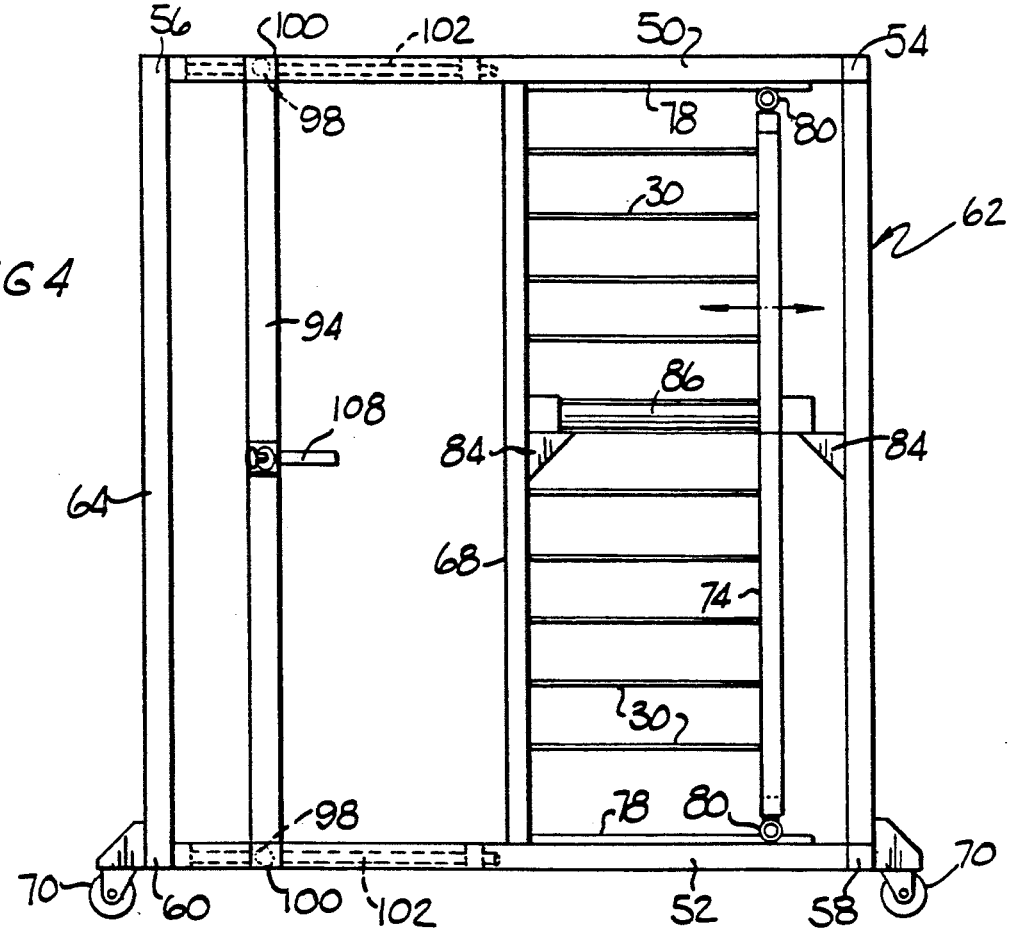
FIG. 4 is a side view of the apparatus of FIG. 3.

Referring to FIGS. 3 and 4, the apparatus for carrying out the functions described above is indicated generally at 48 and includes upper and lower side horizontal support frames 50 and 52, front and back upper horizontal support frames 54 and 56, front and back lower horizontal support frames 58 and 60, and front and back vertical support frames 62 and 64. Intermediate horizontal support frames 66 secured to intermediate vertical support frames 68 are attached to the main support frames enumerated above to provide further structural support and to carry the frame members 42, which are shown in FIGS. 2A, 2B, and 2C as supporting the guides 40. The apparatus 48 is preferably mounted on wheels or casters 70 to allow the apparatus to be moved to different locations on the shop floor as needed.

Figure 5:
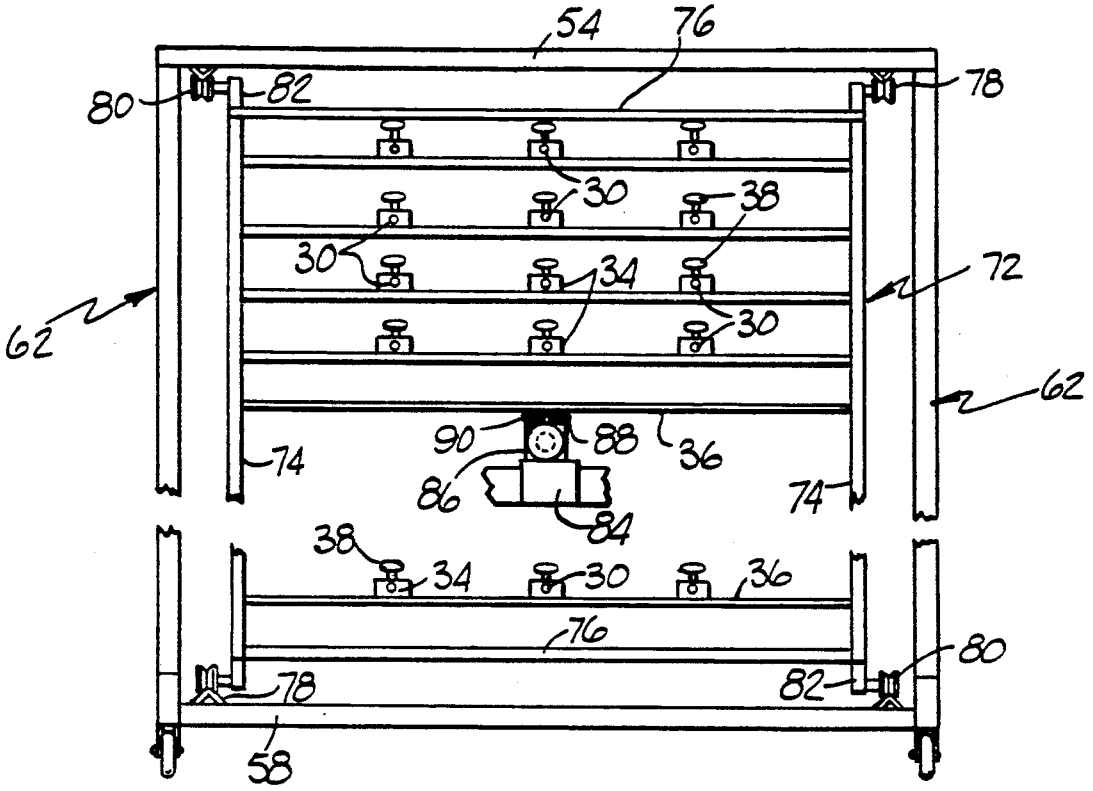
FIG. 5 is a front view of the frame on which the piercing means is mounted, looking toward the front of the apparatus.

Referring to FIGS. 3, 4 and 5, a tube or rod support frame 72 comprises vertical supports 74 and upper and lower horizontal supports 76. Cross support frame members 36, equal in number to the number of rows of wire reinforcements in the length of duct being fabricated, carry the bushings 34 which in combination with their thumb screws 38 clamp the ends of the tubes 30 in place. The frame 72 is mounted for movement toward and away from the back of the apparatus 48 along angle tracks 78. V-grooved wheels 80, attached to the upper and lower horizontal supports 76 by brackets 82, ride on the tracks 78 to enable the frame 72 to move. Mounted on brackets 84, which are attached to vertical support frame 62 and to intermediate vertical support frame 68, is a centrally located air cylinder 86. Extending upwardly from the cylinder through a slot in the upper surface thereof is a bracket 88 which is connected to the movable piston of the cylinder, the bracket 88 being attached to brackets 90 depending from one of the cross frame members 36. Upon actuation of the cylinder by the operator, preferably through a foot pedal and circuit not shown but well known in the art, movement of the piston will move the frame 72 a like distance. Although it is preferred to use an air cylinder of the type described, other types of actuating devices could be used instead without departing from the invention. Also, it may be desirable to use two cylinders, one on each side of the apparatus, instead of the single cylinder shown, in order to stabilize the movement of the piercing tube frame.

Figure 6:
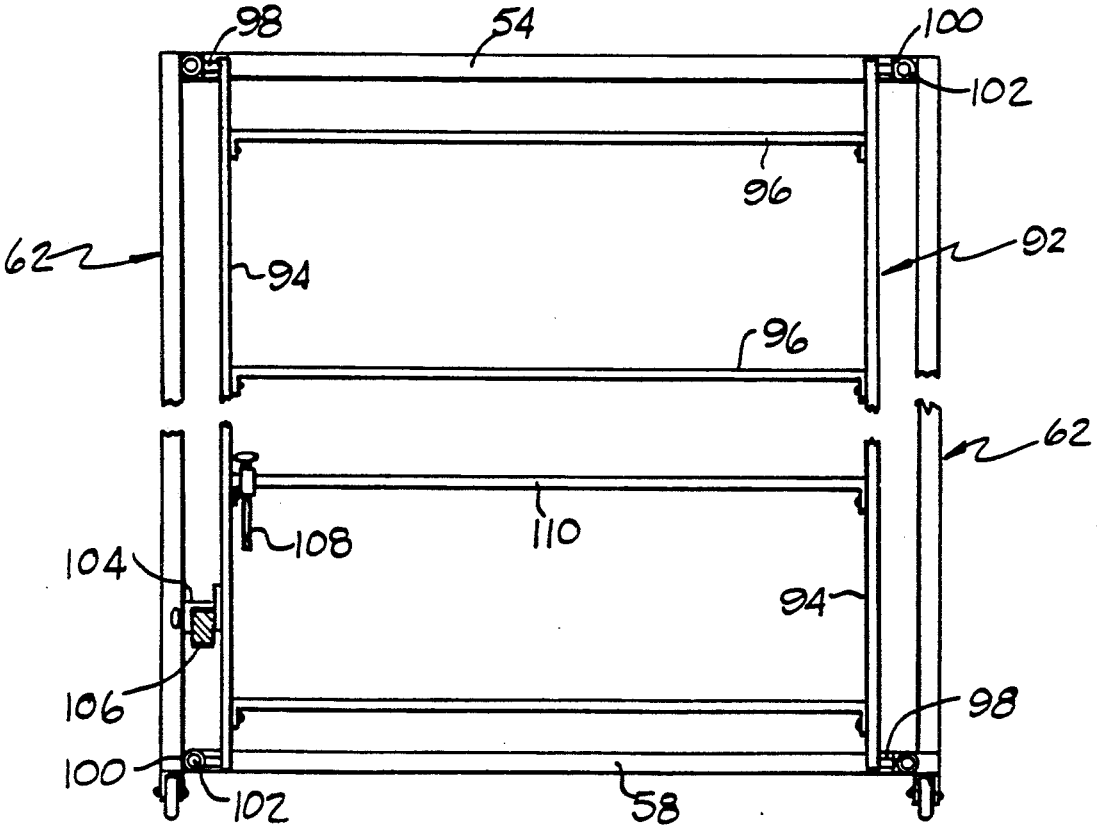
FIG. 6 is a front view of the duct support frame, also looking toward the front of the apparatus.

Referring to FIGS. 3, 4 and 6, duct back-up frame 92 comprises vertical support frames 94 and a plurality of horizontal support frames 96. Attached to the vertical support frames 94 by brackets 98 are bushings 100 which are supported on rods 102. The rods 102 are mounted on the upper and lower horizontal frames 50 and 52, permitting the back-up frame 92 to be moved along the rods. Such movement need only be done by hand in order to position the back-up frame in the proper location so as to provide support to the back of the duct as the walls of the duct are being pierced. The back-up frame is able to be locked in position by the clamp 104 which is attached to the back-up frame 92 and which is slidably mounted on stationary frame member 106. In addition, a stop member 108 mounted on horizontal rod 110 can be positioned at any point along the length of the rod 110 so as to correspond to the desired location of the wall 18 of the duct length 10. The stop 108 is shown in operative condition in FIG. 4 and in inoperative condition in FIG. 6.

In operation, the stop member 108 and the back-up frame 92 are set at the proper locations in order for a duct length to be positioned between the back-up frame 92 and the intermediate support frames 66 and 68. The distance between the back-up frame and the intermediate support frames corresponds to the short dimension of the duct, which in turn corresponds to the height or depth of the walls 16 and 18. The clamp bushings 34 will have been set along their support frame member 36 so that the piercing tubes 30 mounted in the clamps are aligned with the desired locations of the reinforcing wires.

Upon actuation of the cylinder 86 the tube support frame 72 moves toward the back-up frame until the tubes have fully pierced the walls 12 and 14 of the duct. The reinforcing wires are then easily inserted through the duct walls simply by pushing them through the tubes. The cylinder can then be actuated again in the reverse direction to remove the tubes, and the wire can be cut at a point spaced from the wall 12, leaving enough wire to work with to allow the washers 28 to be slipped over the wire ends and the wire ends to be twisted, bent or otherwise secured in place on the outer surface of the washers.

This procedure is much faster than reinforcing the duct entirely by hand and results in more precisely located reinforcing wires. The duct walls are pierced in the desired locations but are not damaged by the operation. Obviously, although the use of tubes as the piercing members is preferred, other suitable cross-sectional shapes of rods or shafts can be employed to accomplish the same thing. A bar comprised of angled legs, for example, could be used, with the area at which the legs meet serving as a guide for the introduction of the reinforcing wire.

Referring to FIG. 7, another embodiment which eliminates the need entirely for a piercing tube is illustrated. In this embodiment the guide bushing 40' and the clamp bushing 34' are dimensioned to fit the diameter of the reinforcing wire itself instead of the larger diameter of the piercing tubes. Operation of the apparatus will therefore result in the wire being moved directly through the walls of the duct, thus producing its own apertures in the walls. Although such an arrangement could be used with reinforcing wire of relatively high gauge, it would not be as effective as the preferred embodiment when using lower gauge wire or when using fiber glass board having a density at the higher end of the density range.

Figure 8:
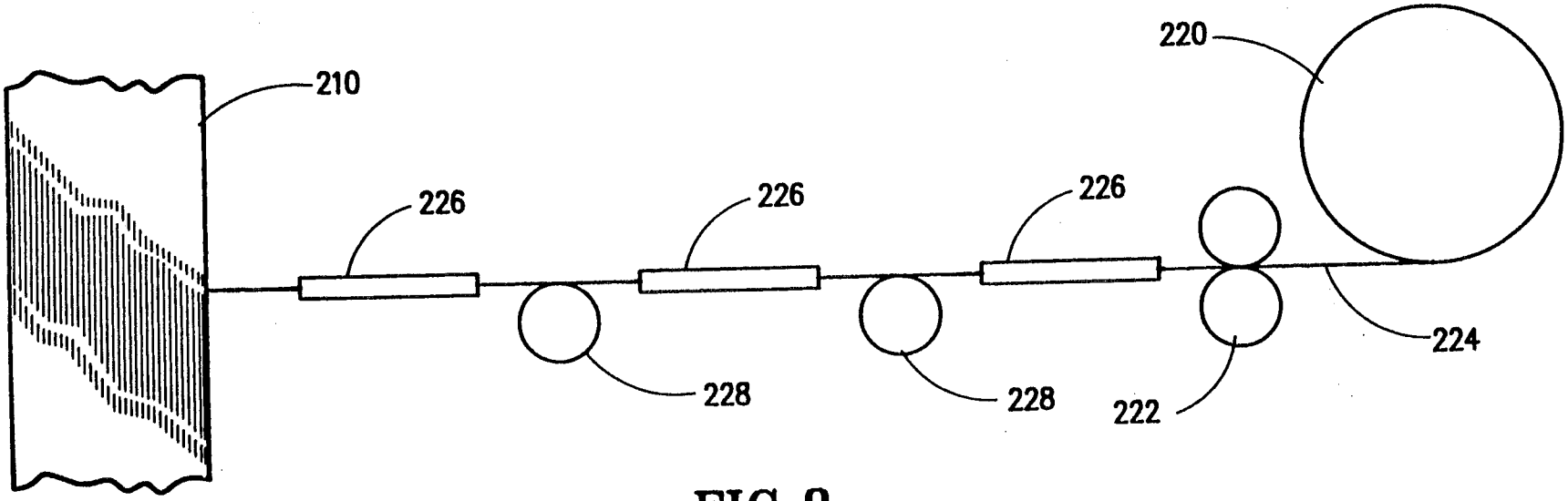
FIG. 8 is a schematic view of means for feeding and straightening reinforcement wire.

In FIG. 8 there is illustrated a schematic view of means for feeding and straightening the reinforcement wire 224 in which the reinforcement wire 224 is pulled from a supply roll 220 by a pair of pull rolls 222 and fed through one or more guides 226 and straightener rolls 228 into a duct 210.

It should be understood that although a preferred embodiment of the invention has been disclosed, a number of the details described may be modified according to preference without departing from the spirit and scope of the invention as defined in the claims.

What is claimed is:

1. Apparatus for use in inserting tensile reinforcement means transversely through a length of fibrous duct, comprising:

a support frame;

a back-up frame mounted on the support frame for supporting ne side of a length of fibrous duct;

movable support means on the opposite side of the duct mounted for movement toward and away from the duct, the movable support means being connected to a reciprocally movable frame mounted for reciprocal movement on the support frame;

the movable support means supporting elongated means aligned substantially at right angles to the length of the duct and extending between the movable support means and the duct, the elongated means being capable of penetrating said one and said opposite sides of the duct;

means for moving the movable support means toward the duct to cause the elongated means to penetrate both sides of the duct; and means for preventing the opposite side of the duct from collapsing upon impact by the elongated means.

2. Apparatus for use in inserting tensile reinforcement means transversely through a length of fibrous duct, comprising:

a support frame;

a back-up frame mounted on the support frame for supporting one side of a length of fibrous duct;

movable support means on the opposite side of the duct mounted for movement toward and away from the duct, the movable support means being connected to a reciprocally movable frame mounted for reciprocal movement on the support frame;

the movable support means including means for gripping elongated means aligned substantially at right angles to the length of the duct and extending between the movable support means and the duct, the elongated means being capable of penetrating said one and said opposite sides of the duct; and means for moving the movable support means toward the duct to cause the elongated means to penetrate both sides of the duct.

3. Apparatus according to claim 2, further including cylinder means mounted on the support frame and being operatively connected to the reciprocally movable frame to cause reciprocal movement thereof.

4. Apparatus according to claim 2, wherein the support frame, the back-up frame and the reciprocally movable frame are arranged so as to receive a vertically oriented length of duct, whereby the reciprocally movable frame moves generally horizontally.

5. Apparatus according to claim 2, including guide means located between the gripping means and the duct to guide the elongated means in its movement toward the duct.

* * * * *